US005581057A

United States Patent [19]

Ferrario et al.

[11] Patent Number: 5,581,057

[45] Date of Patent: Dec. 3, 1996

[54] ELEVATOR CAR FOR AN OPEN ELEVATOR SHAFT

[75] Inventors: Renato Ferrario, Udlidligenswil; Alan F. Green, Luzern, both of Switzerland

[73] Assignee: Inventio AG, Hergiswil NW, Switzerland

[21] Appl. No.: 373,779

[22] Filed: Jan. 17, 1995

[30] Foreign Application Priority Data

Jan. 27, 1994 [EP] European Pat. Off. ..... 94101177

[51] Int. Cl.[6] ..... B66B 1/34

[52] U.S. Cl. ..... 187/396; 187/401; 187/414; 24/437

[58] Field of Search ..... 187/396, 347, 187/401, 402, 414, 413; 345/905; 24/441, 437

[56] References Cited

U.S. PATENT DOCUMENTS

| | | | |
|---|---|---|---|
| 4,394,888 | 7/1983 | Clarke | 187/1 R |
| 4,677,779 | 7/1987 | Rodriguez | 40/514 |
| 5,277,512 | 1/1994 | Dwillies | 403/348 |
| 5,362,117 | 11/1994 | Bennett | 294/82.23 |
| 5,379,865 | 1/1995 | Berdrich et al. | 187/398 |

FOREIGN PATENT DOCUMENTS

| | | | |
|---|---|---|---|
| 54-115937 | 9/1979 | Japan | 187/413 |
| 1-247386 | 10/1989 | Japan | 187/397 |
| 1-261185 | 10/1989 | Japan | 187/401 |
| 2-123081 | 5/1990 | Japan . | |
| 2-215685 | 8/1990 | Japan | 187/413 |
| 2-231379 | 10/1990 | Japan | 187/397 |
| 4-20478 | 1/1992 | Japan | 187/413 |
| 2263097 | 7/1993 | United Kingdom | 187/401 |

OTHER PUBLICATIONS

K. Masuda and H. Haginaka, *Hitachi Passenger Elevator "New Building–Ace"*, pp. 331–338, Dec. 1989, Japan.

*Primary Examiner*—Robert Nappi

*Attorney, Agent, or Firm*—Howard & Howard Attorneys

[57] ABSTRACT

An elevator car has transparent side walls and is guided in an open elevator shaft to provide passengers with an unobstructed view of the surroundings outside the car. An information display apparatus is detachably coupled to an outer surface of a side wall of the elevator car to attract the attention of persons outside the car and provide information of a technical, an entertaining, an educational or a promotional. The information display apparatus uses an image forming screen electrically connected to the elevator car and a display panel removably retained in front of the screen to provide such information.

19 Claims, 3 Drawing Sheets

ELEVATOR CAR FOR AN OPEN ELEVATOR SHAFT

BACKGROUND OF THE INVENTION

The present invention relates generally to elevator cars for use in open elevator shafts and, in particular, to such an elevator car having an apparatus for displaying information to persons outside the car.

Elevator cars visible from outside the elevator shaft are gaining more importance as an architectural element for building facades and internal courts. On the one hand, the elevator car serves as a transport means and, on the other hand, the car movement is used as means for influencing the aesthetic make-up of the building. In the case of passenger elevators, elevator cars with transparent walls, so-called panorama cars, are used in most cases. In the case of freight elevators, typically closed elevator cars are used either in open elevator shafts or in elevator shafts having transparent walls.

SUMMARY OF THE INVENTION

The present invention concerns an elevator car for use in an open elevator shaft and having an apparatus for displaying information to persons outside the car. The car has an outer surface of a side wall visible when the elevator car is travelling in an open elevator shaft and a mounting means having a first mounting portion attached to the outer surface and a second mounting portion detachable from the first mounting portion. An information display apparatus is attached to the second mounting portion for displaying at least one of a technical, an entertaining, an educational and a promotional type of information to the persons located outside the car. The information display apparatus includes a frame surrounding and retaining an image forming screen, the frame having a guide groove formed therein, and a display panel releasably retained in the guide groove.

The first mounting portion includes at least two mounting pads attached to the outer surface of the side wall and the second mounting means includes at least two slide blocks attached to the frame. Each of the mounting pads has a generally T-shaped cavity formed therein and a transverse aperture formed therein for receiving a corresponding one of the slide blocks and including a latching pin with a lock means for insertion into the aperture to prevent removal of the corresponding slide block from the cavity. In the alternative, the first mounting portion includes at least two slide blocks retained in a pair of posts included in the side wall and the second mounting portion is a pair of connecting members attached to the frame.

An advantage achieved by the present invention is that the much observed external car surface can be used for information and promotion purposes.

A further advantage of the present invention is that the elevator shaft and the elevator car can be constructed to be more versatile.

Other advantages of the present invention are a rapid assembly of the information and promotion display apparatus to the elevator car without tools, a plug and socket connection—which meets the elevator safety requirements—of an image forming screen with the elevator car and no impairment of the external make-up of the elevator car in case the elevator car is operated without information and promotion apparatus.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
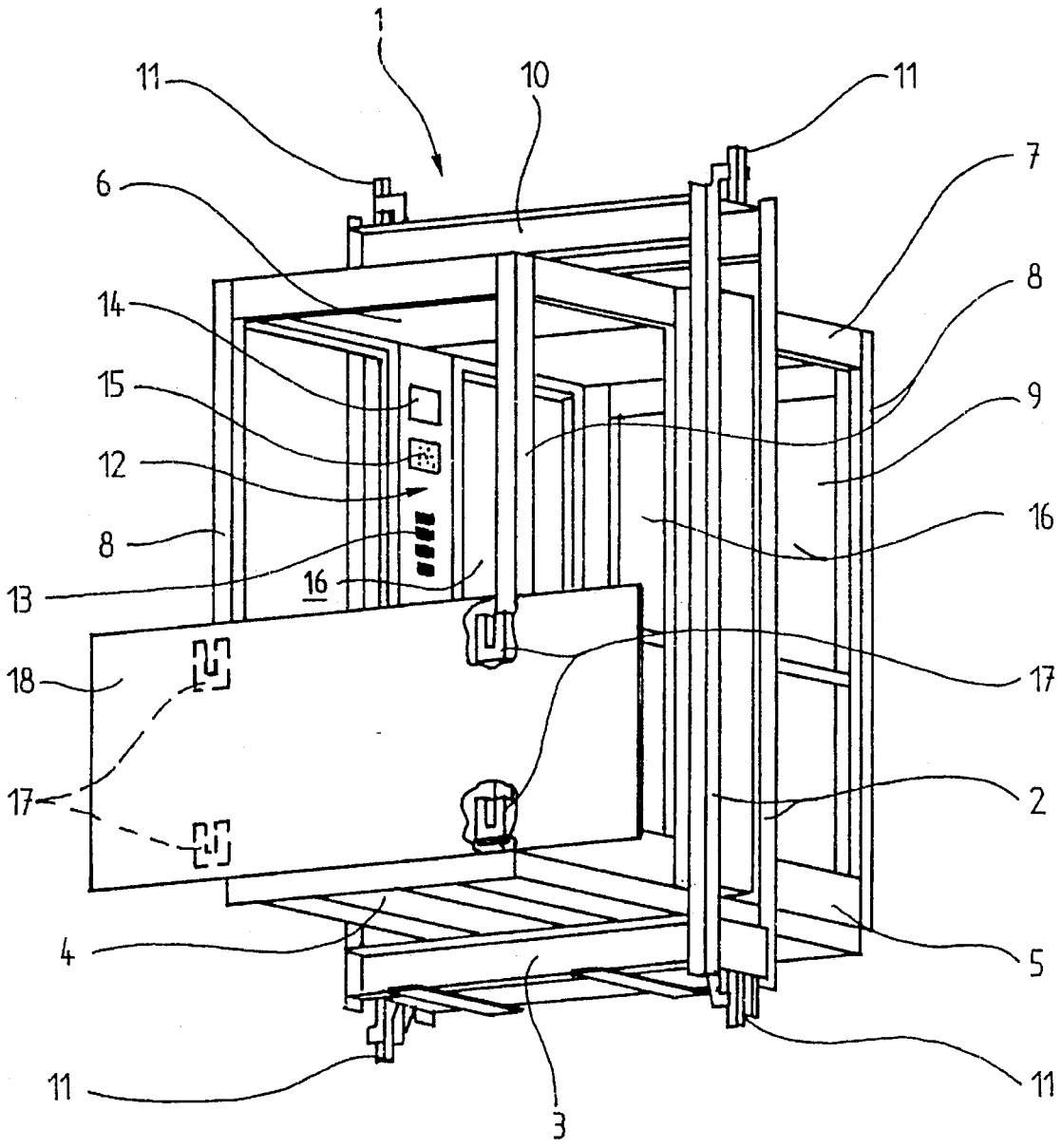
FIG. 1 is a perspective view of an elevator car having a display screen in accordance with the present invention.
Figure 2:
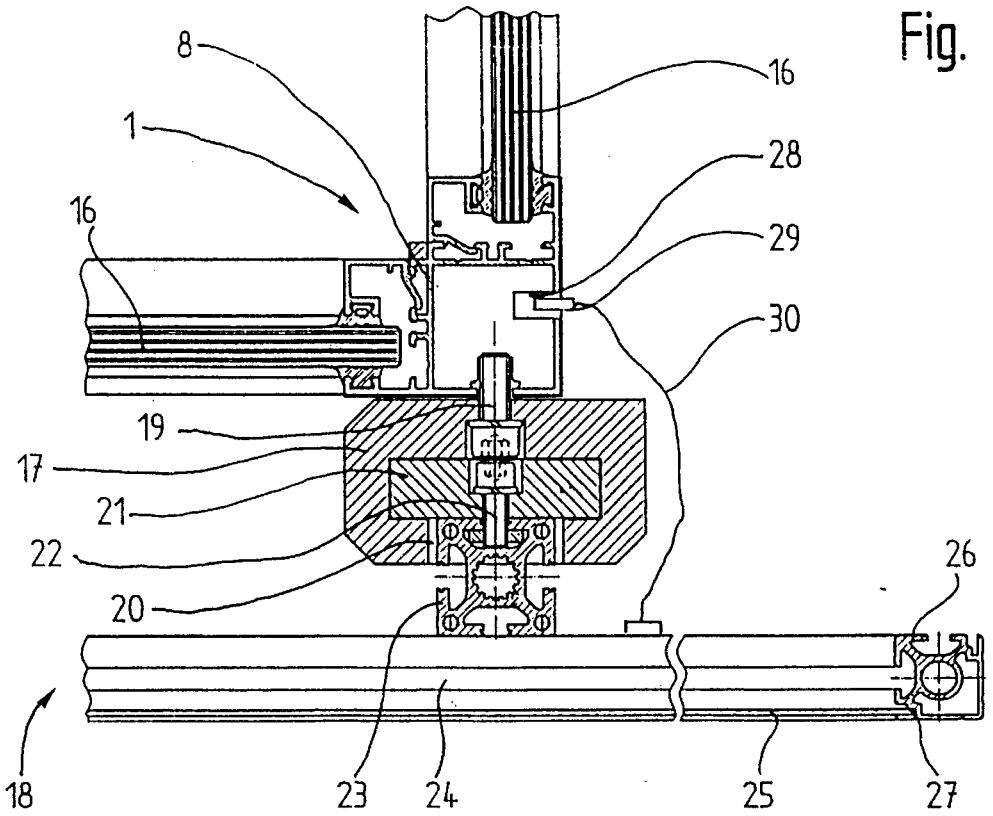
FIG. 2 is an enlarged, fragmentary cross-sectional view of a corner of the elevator car and display screen shown in the FIG. 1.

As shown in the FIGS. 1 through 4, an elevator car 1 is retained in and supported by a carrier frame 2. The carrier frame 2 has a generally horizontally extending lower yoke 3 which supports a floor 4 of the elevator car 1. The elevator car 1 includes a peripheral floor frame 5 extending about a lower end thereof and attached to the floor 4. A ceiling 6 is attached to a peripheral ceiling frame 7 extending about an upper end of the car 1. A plurality of generally vertically extending posts 8 connect the floor 4 to the ceiling 6. At least one door 9 is formed in a side of the elevator car 1.

An upper yoke 10 of the carrier frame 2 extends generally horizontally above the ceiling 6 of the elevator car 1. A plurality of guide shoes 11 are attached to the ends of the upper yoke 10 and to the ends of the lower yoke 3 to guide the elevator car 1 along a pair of vertically extending guide rails which are not shown. Also not illustrated are cables attached to the upper yoke 10 of the carrier frame 2 which suspend the elevator car 1 and cooperate with a cable drive (not shown) to move the car along the guide rails in an open elevator shaft. Typically, an open elevator shaft does not have walls on at least the three sides of the car 1 which do not include the door 9. In the alternative, an hydraulic drive can be substituted for the cables and cable drive which drive includes a piston movable in an hydraulic cylinder and engaging the lower yoke 3 of the carrier frame 2 to raise and lower the elevator car 1.

When the elevator car 1 stops at a floor, the door 9 together with a not illustrated floor door is opened to enable passengers to leave and board the elevator car. A panel 12 mounted in the elevator car includes a plurality of call buttons 13 to enable passengers to communicate their travel commands to an elevator control (not shown). The passengers are informed of current and future operations of the elevator car 1 by the elevator control through a display 14 mounted in the panel 12 and/or a loudspeaker 15 also mounted in the panel. A plurality of glazings 16, or other form of transparent panels, extend between the base frame 5 and the ceiling frame 7 and between pairs of the posts 8 to form the side walls of the car 1. The panels 16 provide the elevator passengers with an unobstructed view of the surroundings external to the car 1. In the case where the elevator car 1 is installed inside a building, the elevator passengers thereby have the opportunity during their travel to follow the events in the building. In the case of an installation external to the building, the elevator passengers thereby have the opportunity during their travel to follow the events in the surroundings of the building. Open elevator shafts not only provide the elevator passengers with a view of the surroundings of the elevator car 1, but also attract the attention of externally situated persons to the moving elevator car.

A mounting means includes a first mounting portion attached to the elevator car and a detachably coupled second mounting portion attached to an information display apparatus as described below. The first mounting portion includes a plurality of mounting pads 17 attached to the posts 8 at the outer surface of the side of the elevator car 1 opposite the door 9. As shown in the FIG. 1, two of the pads 7 are attached in a vertically spaced relationship to each of the two posts 8 which define a rear wall of the elevator car 1. A generally rectangular information display apparatus 18 is retained by the mounting pads 17 to provide information of a technical, an entertaining, an educational or a promotional kind to the persons situated in the surroundings of the elevator car 1 without impairing the view of the passengers in the car. As shown in more detail in the FIG. 2, the pad 17 is attached to the post 8 by a first threaded fastener 19. The mounting pad 17 is generally rectangular in cross section with a generally T-shaped vertically extending central cavity 20 formed therein and opening through a wall of the pad toward the display apparatus 18. The cavity 20 extends from and is open at the top of the pad 17 and is terminated before reaching the bottom of the pad (see the FIG. 1). The fastener 19 extends from the cavity 20 through an aperture formed in a wall of the pad 17 facing the post 8. A slide block 21, one of four, is inserted into the open top of the cavity 20 for vertical movement relative to the pad 17 and rests on the closed bottom of the cavity. A second threaded fastener 22 extends through an aperture formed in the slide block 21 and threadably engages a connecting member 23 attached to a rearwardly facing surface of the information display apparatus 18. Two of the pads 17 are attached to the connecting member 23 and another two of the pads are attached a second connecting member (not shown) in the manner described above. Thus, the apparatus 18 is detachably coupled to the elevator car 1 by inserting the four slide blocks 21 into the cavities 20 of the corresponding ones of the four mounting pads 17 on the car.

The information display apparatus 18 includes a first information display device, such as a generally vertically extending, rectangular planar image forming screen 24 for positioning adjacent to the car 1, and a second information display device, such as a generally rectangular planar display panel 25 extending parallel to the screen on the side of the screen opposite the car. A frame 26 is attached to the two connecting nembers 23 and extends about a periphery of the image forming screen 24 thereby retaining the screen. The frame 26 has a guide groove 27 formed therein into which the display panel 25 can be pushed and releasably retained. In the case where promotional material, for example promotional placards, are used as an information source, the display panel 25 is placed in front of the image screen 24 whereby the placard is the display panel or is attached to the display panel and faces away from the screen for viewing by persons external to the car 1. Furthermore, the display panel 25 can be used for the mounting of works of art, such as pictures or sculptures. In the case where the image forming screen 24 is used to display information, it can be any suitable display means such as, for example, a controllable luminescent diode field, or a plasma image screen, or a cathode ray tube screen.

The information data and electrical energy necessary for operating the screen 24 are transmitted from an information source (not shown) which source can be located in or external to the car 1. If the information source is external to the car 1, it can be electrically connected through a cable, for example, the cable connected to the controls behind the panel 12. In either case, the information source is connected to an electrical socket 28 mounted on one of the posts 8 having the mounting pads 17 attached thereto. The socket 28 receives an electrical plug 29 connected to one end of an electrical cable 30 having an opposite end connected to the screen 24. Although both the image forming screen 24 and the display panel 25 are shown, the information display apparatus 18 could consist of the frame and only one of the screen and the panel. Furthermore, the car 1 can be operated without the information display apparatus 18 by removing the plug 29 from the socket 28 and detaching the two portions of the mounting means.

Figure 3:
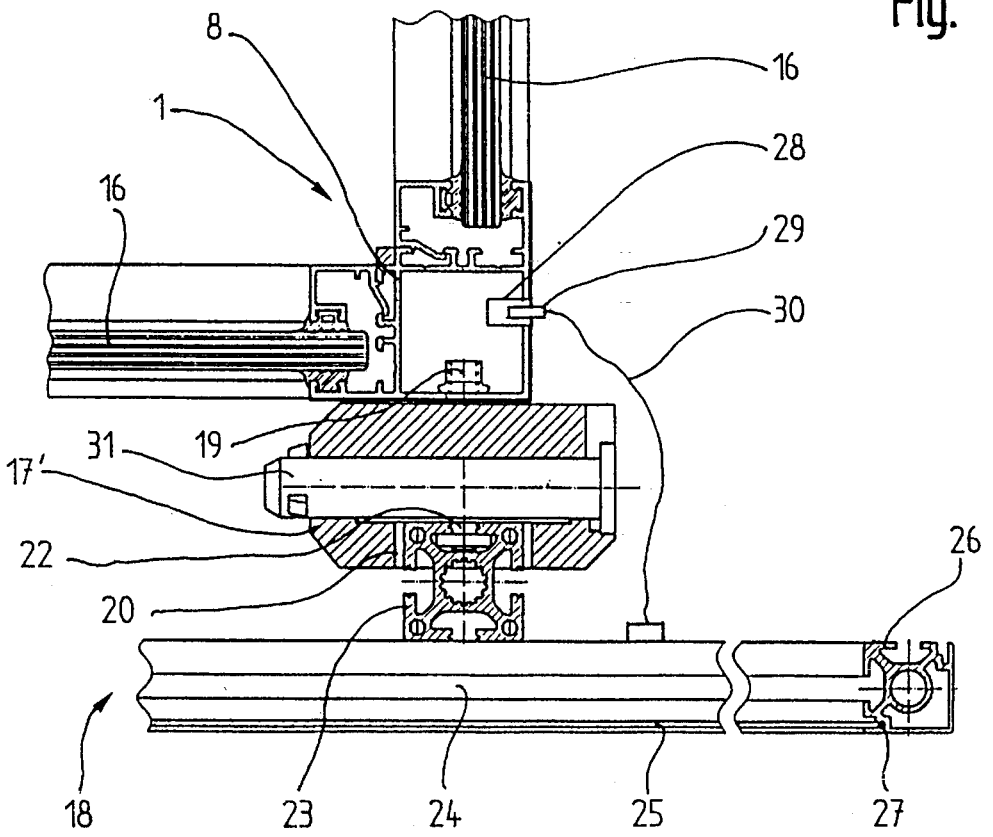
FIG. 3 is a cross-sectional view similar to the FIG. 2 showing an alternate embodiment for mounting the display screen on the elevator car according to the present invention.

An alternate embodiment for mounting the information display apparatus 18 is shown in the FIG. 3. A mounting pad 17', similar to the mounting pad 17, has a transverse aperture formed in an upper portion thereof which aperture is open to opposite side walls of the cavity 20. The aperture retains a latching pin 31 with a lock means whereby the slide block 21 is retained in the cavity 20 and the information display apparatus 18 is rendered theft-proof.

Figure 4:
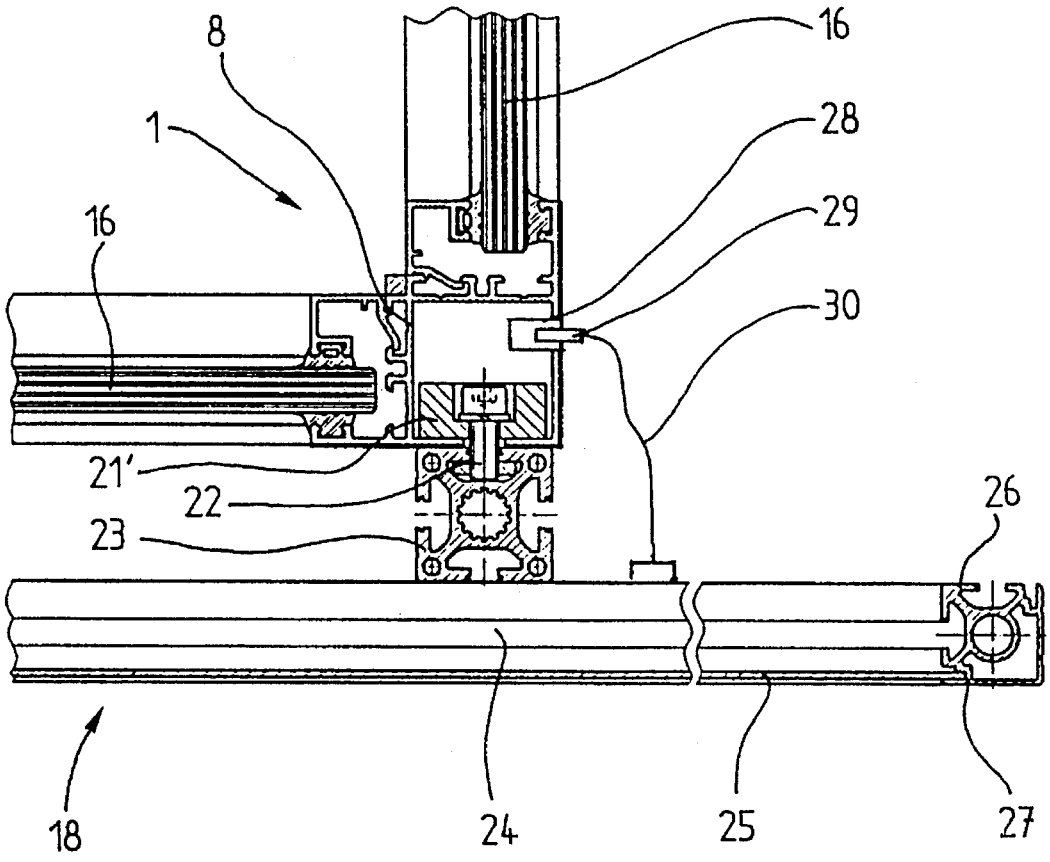
FIG. 4 is a cross-sectional view similar to the FIG. 2 showing another alternate embodiment for mounting the display screen on the elevator car according to the present invention.

A second alternate embodiment for mounting the information display apparatus 18 is shown in the FIG. 4. The post 8 of the elevator car 1 is hollow and retains a slide block 21' which is similar to the slide block 21. Thus, the slide block 21' cannot be seen from outside the elevator car 1. The second fastener 22 detachably couples the connecting member 23 on the apparatus 18 with the slide block 21'.

Technical information which can be displayed on the image forming screen 24 consists, for example, of statements about the car speed, number of elevator passengers, elevator size, statistical evaluations and analyses of the passenger traffic, fault reports or notices for certain persons. The entertaining, educational and promotional information which can be displayed on the screen 24 consists, for example, of prerecorded material controlled at the elevator location such as cartoons, films or commercial spots, or broadcast material from a remote location. The information can be communicated, for example, in the form of text, graphics, and/or images in still or sequential modes.

Although shown as having a generally rectangular shape, the display panel 25, for example, can be formed in any shape such as an Easter bunny, an apple, an Emmentaler cheese, a wine glass or a beer jug and can be detachably connected with the elevator car 1 by means of the mounting pads 17 or 17' and the slide blocks 21 or 21' in a position which does not impair the view of the elevator passengers. The above mentioned forms and figures can be made, for example, from inflatable sleeves or foamed materials, such as STYROPOR.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car for use in an open elevator shaft comprising:

an elevator car having a side wall with an outer surface visible when said elevator car is travelling in an open elevator shaft;

a mounting means having a first mounting portion attached to said outer surface of said side wall and having a second mounting portion detachable from said first mounting portion; and an information display apparatus attached to an outer side of said second mounting portion and spaced from said outer surface of said side wall, said information display apparatus displaying at least one of technical, entertaining, educational and promotional information to persons located outside said elevator car.

2. The elevator car according to claim 1 wherein said information display apparatus includes an image forming screen for displaying said information.

3. The elevator car according to claim 2 wherein said image forming screen is one of a luminescent diode field, a plasma image screen and a cathode ray tube screen.

4. The elevator car according to claim 2 wherein said information display apparatus includes a frame surrounding and retaining said image forming screen, said frame having a guide groove formed therein, and a display panel releasably retained in said guide groove.

5. The elevator car according to claim 1 wherein said information display apparatus includes a display panel for displaying at least one of promotional material and art objects.

6. The elevator car according to claim 5 wherein said display panel is formed in a shape of an object to be promoted.

7. The elevator car according to claim 6 wherein said display panel is formed in a shape of one of an Easter bunny, an apple, an cheese, a wine glass and a beer jug.

8. The elevator car according to claim 1 wherein said first mounting portion includes at least one mounting pad attached to said outer surface of said side wall of said elevator car.

9. The elevator car according to claim 8 wherein said mounting pad has a generally T-shaped cavity formed therein and said second mounting portion includes a slide block vertically movable in said cavity and attached to said information display apparatus.

10. The elevator car according to claim 9 wherein said mounting pad has a transverse aperture formed therein and including a latching pin with a lock means for insertion into said aperture to prevent removal of said slide block from said cavity.

11. The elevator car according to claim 1 wherein said first mounting portion is at least one slide block retained in a post included in said side wall and said second mounting portion is a connecting member attached to said information display apparatus.

12. An elevator car for use in an open elevator shaft comprising:

an elevator car having an outer surface of a side wall visible when said elevator car is travelling in an open elevator shaft;

a mounting means having a first mounting portion attached to said outer surface of said side wall and having a second mounting portion detachable from said first mounting portion, and an information display apparatus attached to an outer side of said second mounting portion; and spaced from said outer surface of said side wall, said information display apparatus displaying at least one of technical, entertaining, educational and promotional information to persons located outside said elevator car, said information display apparatus including an image forming screen for displaying said information.

13. The elevator car according to claim 12 wherein said information display apparatus includes a frame surrounding and retaining said image forming screen, said frame having a guide groove formed therein, and a display panel releasably retained in said guide groove.

14. The elevator car according to claim 12 wherein said first mounting portion includes at least two mounting pads attached to said side wall of said elevator car and said second mounting means includes at least two slide blocks attached to said information display apparatus.

15. An information display apparatus for use with an elevator car travelling in an open elevator shaft comprising:

a frame;

a first information display device retained by said frame;

a second information display device releasably retained by said frame;

a mounting means having a first mounting portion attached to an outer surface of a side wall of an elevator car and having a second mounting portion detachable from said first mounting portion, wherein said second mounting portion has an outer side and is attached to said frame, whereby when said second mounting portion is attached to said first mounting portion, said frame is spaced from the outer surface of the side wall.

16. The information display according to claim 15 wherein said first information display device includes an image forming screen for displaying at least one of technical, entertaining, educational and promotional information to persons located outside the elevator car when said information display apparatus is attached to the outer surface of the side wall of the elevator car.

17. The information display according to claim 15 wherein said first mounting portion includes four mounting pads for attachment to the outer surface of the side wall of the elevator car and said second mounting means includes four slide blocks attached to said frame.

18. The information display according to claim 17 wherein each of said mounting pads has a generally T-shaped cavity formed therein and a transverse aperture formed therein for receiving a corresponding one of said slide blocks and including a latching pin with a lock means for insertion into said aperture to prevent removal of said corresponding slide block from said cavity.

19. The information display according to claim 15 wherein said first mounting portion includes four slide blocks retained in a pair of posts included in the side wall and said second mounting portion is a pair of connecting members attached to said frame.

* * * * *